United States Patent [19]

Hayashi et al.

[11] 4,347,860

[45] Sep. 7, 1982

[54] GENERAL COIN COUNTING DEVICE FOR AUTOMATIC VENDING MACHINE

[75] Inventors: Yukichi Hayashi; Osamu Sugimoto, both of Sakado; Yutaka Yokohda, Kamifukuoka, all of Japan

[73] Assignee: Kabushiki Kaisha Nippon Coinco, Tokyo, Japan

[21] Appl. No.: 201,195

[22] Filed: Oct. 27, 1980

[51] Int. Cl.[3] ..... G07D 9/00

[52] U.S. Cl. ..... 133/1 R; 133/8 R; 235/92 CN

[58] Field of Search ..... 133/1 R, 8 R; 235/2, 235/92 CN; 194/DIG. 1, DIG. 3

[56] References Cited

U.S. PATENT DOCUMENTS

| | | | |
|---|---|---|---|
| 3,239,047 | 3/1966 | Maxwell | 133/8 R |
| 3,279,480 | 10/1966 | Jarvis | 133/8 R |
| 3,282,272 | 11/1966 | Griesemer et al. | 133/1 R |
| 3,323,527 | 6/1967 | Wu | 235/92 CN |
| 3,807,417 | 4/1974 | Shigemori et al. | 133/1 R |
| 4,041,280 | 8/1977 | Ohsako et al. | 235/92 CN |
| 4,109,774 | 8/1978 | Hayashi | 133/1 R |
| 4,258,837 | 3/1981 | Manos et al. | 235/92 CN |

*Primary Examiner*—Allen N. Knowles

*Attorney, Agent, or Firm*—Cushman, Darby & Cushman

[57] ABSTRACT

In a coin counting device for an automatic vending machine, the outputs of counters adapted to counts the number of inserted coins separately according to the denominations of the coins are multiplied by the factors which are set by setting circuits separately according to the denominations, respectively, to obtain the total amount of money of the inserted coins. The factors can be changed according to the denominations of coins to be handled by the automatic vending machine, without modifying the circuitry, so that the device can handle coins of any denominations.

1 Claim, 2 Drawing Figures

GENERAL COIN COUNTING DEVICE FOR AUTOMATIC VENDING MACHINE

BACKGROUND OF THE INVENTION

This invention relates to a coin counting device for an automatic vending machine, which can count coins of any denominations (hereinafter referred to as "a general coin counting device" when applicable).

In a conventional coin counting device in an automatic vending machine, coin detection pulses generated when inserted coins are detected separately according to the denominations are applied to pulse forming circuits. In each of the pulse forming circuits, pulses the number of which corresponds to the amount of money of the inserted coins of the respective denomination are formed. The pulses are counted by a counter to determine the total amount of money of the inserted coins. In the conventional coin counting device, the pulse forming circuits which form pulses the numbers of which are in correspondence to the amounts of money of the detected coins are fixedly set to the denominations of coins handled by its automatic vending machine. Accordingly, before changing the denominations of coins handled thereby, it is necessary to change all of the pulse forming circuits.

SUMMARY OF THE INVENTION

Accordingly, an object of this invention is to provide a general coin counting device for an automatic vending machine, in which the above-described difficulty accompanying a conventional coin counting device has been eliminated.

More specifically, an object of the invention is to provide a general coin counting device for an automatic vending machine, which can count coins of any denominations without changing the circuitry.

The foregoing object and other objects of the invention have been achieved by the provision of a general coin counting machine which, according to the invention, comprises: a plurality of counters for counting the number of coin inserted, separately according to the denominations thereof; a plurality of ratio setting circuits for suitably setting ratios corresponding to the denominations, respectively; and arithmetic means for multiplying the outputs of the counters by the ratios set by the ratio setting circuits, the ratios set by the ratio setting circuits being changed, so that the device can handle coins of any denominations.

The principle, nature and utility of the invention will become more apparent from the following detailed description and the appended claim when read in conjunction with the accompanying drawings, in which like parts are designated by like reference numerals or characters.

DETAILED DESCRIPTION OF THE INVENTION

Figure 1:
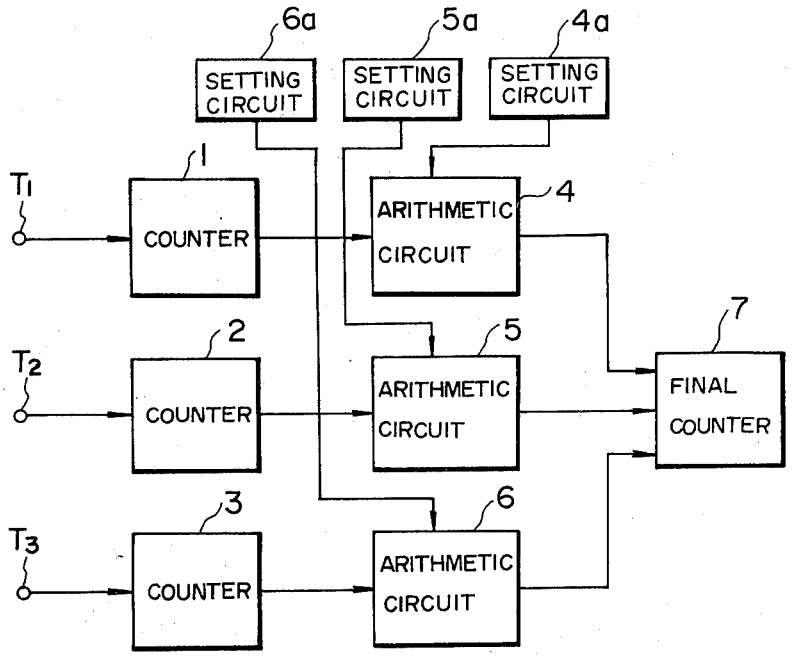
FIG. 1 is a block diagram showing one example of a general coin counting device for an automatic vending machine, according to this invention.

One example of a general coin counting device according to this invention is as shown in FIG. 1, which is provided for handling coins of three different denominations.

Pulse signals indicating the insertions of coins detected separately according to the three denominations are applied to terminals T1, T2 and T3, respectively. For instance, a pulse signal indicating the insertion of a 10-yen coin is applied to the terminal T1, a pulse signal indicating the insertion of a 50-yen coins to the terminal T2, and a pulse signal indicating the insertion of a 100-yen coin to the terminal T3. These pulse signals are applied to counters 1, 2 and 3, respectively, and the outputs of the counters 1, 2 and 3 are applied to arithmetic circuits 4, 5 and 6, respectively. The arithmetic circuits 4, 5 and 6 are made up of multipliers in which the count values of the counters 1, 2 and 3 are multiplied by predetermined ratios, respectively. The predetermined ratios are set by setting circuits 4*a*, 5*a* and 6*a* as required, respectively. For instance in the case where 10-yen, 50-yen and 100-yen coins are handled as described above, the ratios set by the setting circuits 4*a*, 5*a* and 6*a* are 1, 5 and 10, respectively.

It is assumed that four 10-yen coins, one 50-yen coin and two 100-yen coins are inserted. Then, in this case, the count contents of the counters 1, 2 and 3 are 4, 1 and 2, respectively. Accordingly, the arithmetic circuits 4, 5 and 6 outputs $4=4\times1$, $5=1\times5$ and $20=2\times10$, respectively. The outputs of the arithmetic circuits 4, 5 and 6 are applied to a final counter 7, in which the outputs are added to provide a numerical value corresponding to the total amount of money of the inserted coins, and the total amount of money is calculated according to the numerical value thus provided.

As is clear from the above description, in the invention, the inserted coins are counted separately according to the denominations, the resultant count values are multiplied by the predetermined ratios in the arithmetic circuits, and the resultant multiplication data are summed to obtain the total amount of money of the inserted coins. Accordingly, if the ratios set for the arithmetic circuits 4, 5 and 6 are changed by operating the factor setting circuits 4*a*, 5*a* and 6*a* separately according to the denominations of coins handled, respectively, then the general coin counting device of the invention can deal with coins of any denominations. For instance in the case of an automatic vending machine using 5-cent, 10-cent and 25-cent coins, the ratios can be set to 1, 2 and 5 by the factor setting circuits 4*a*, 5*a* and 6*a*, respectively.

Figure 2:
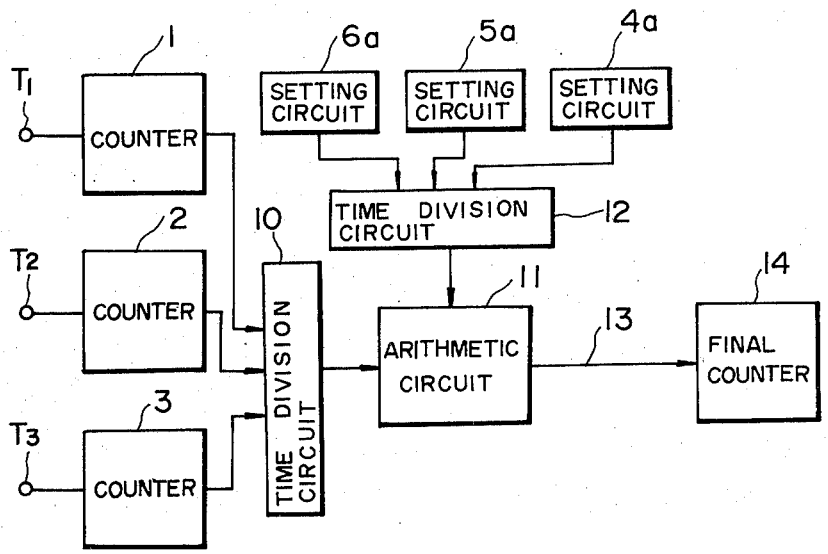
FIG. 2 is also a block diagram showing another example of the general coin counting device of the invention.

FIG. 2 shows another example of the device according to the invention. In this example, the outputs of the counters 1, 2 and 3 which count inserted coins separately according to the denominations are subjected to time division by a time division circuit 10 and are then applied to an arithmetic circuit 11. On the other hand, ratios set by the factor setting circuits 4*a*, 5*a* and 6*a* which set ratios separately according to the denominations are provided in time division manner by a time division circuit 12 operating in synchronization with the aforementioned time division circuit, so that data obtained by multiplying the count values of the counters 1, 2 and 3 by the respective ratios set by the setting circuits are provided in time division manner on the output line 13 of the arithmetic circuit 11. The data thus provided are summed by a final counter 14 to obtain the total amount of money of the inserted coins. In this example also, if the ratios are set according to the denominations of coins to be handled by the factor setting circuits 4*a*, 5*a* and 6*a*, then the device can deal with coins of any denominations.

In the above-described examples, the number of denominations of coins to be handled is only three; however, it does without saying that it may be set to a desired value by increasing or decreasing the numbers of counters and arithmetic circuits.

As is apparent from the above description, the invention has a merit that the device can handle coins of any denomination merely by changing the ratios set of any denominations with the circuitry maintained unchanged.

What is claimed is:

1. A general coin counting device for an automatic vending machine, which comprises:

a plurality of counters for counting the numbers of coins inserted, separately according to the denominations thereof;

a plurality of ratio setting circuits for suitably setting ratios corresponding to the denominations, respectively; and arithmetic means for multiplying outputs of said counters by said ratios set by said ratio setting circuits, said ratios set by said ratio setting circuits being changed, whereby said general coin counting device can handle coins of any denominations.

* * * * *